US005722584A

United States Patent [19]

Fujiwara

[11] Patent Number: 5,722,584

[45] Date of Patent: Mar. 3, 1998

[54] CARTON APPLICABLE AS DISPLAY PACKAGE

[75] Inventor: Jiro Fujiwara, Tokyo-to, Japan

[73] Assignees: Dai Nippon Printing Co., Ltd., Tokyo-to; Otsuka Pharmaceutical Company, Limited, Tokyo, both of Japan

[21] Appl. No.: 758,050

[22] Filed: Nov. 27, 1996

[30] Foreign Application Priority Data

Nov. 30, 1995 [JP] Japan ..... 7-337860

[51] Int. Cl.[6] ..... B65D 5/481

[52] U.S. Cl. ..... 229/120.15; 229/120.18; 229/164; 229/242

[58] Field of Search ..... 229/120.15, 120.18, 229/164, 240, 242

[56] References Cited

U.S. PATENT DOCUMENTS

| | | | |
|---|---|---|---|
| Re. 23,501 | 5/1952 | Lighter | 229/125.15 |
| 713,216 | 11/1902 | Henning | 229/120.15 |
| 4,000,811 | 1/1977 | Hardison et al. | 229/242 |
| 4,143,803 | 3/1979 | Taylor | 229/120.15 |
| 4,313,554 | 2/1982 | Montealegre | 229/120.15 |
| 4,482,055 | 11/1984 | Boyle | 229/120.18 |
| 5,167,324 | 12/1992 | Miller | 229/242 |
| 5,607,058 | 3/1997 | Huesman et al. | 229/120.15 |

FOREIGN PATENT DOCUMENTS

| | | | |
|---|---|---|---|
| 2443232 | 3/1976 | Germany | 229/120.15 |
| 56-38992 | 9/1981 | Japan . | |

*Primary Examiner*—Gary E. Elkins

*Attorney, Agent, or Firm*—Merchant, Gould, Smith, Edell, Welter & Schmidt

[57] ABSTRACT

A carton including a front wall, a rear wall, a right and a left side walls, a bottom wall and a top wall. A longitudinal partition flap is formed by cutting an approximately central portion of the front wall in a U shape. A partition wall of a cross in a plan view consisting of a lateral partition wall, a longitudinal partition wall and the longitudinal partition flap is integrally provided inside the carton. Each side wall has a perforated cut line continuous with an outer end of the perforated tear part formed at each side of the U-shaped cutout. Contents in the carton are exposed and displayed by removing an upper part of the carton along the perforated tear part. The contents are supported by the cross-shaped partition wall and therefore prevented from lying even when decreased in number.

5 Claims, 5 Drawing Sheets

CARTON APPLICABLE AS DISPLAY PACKAGE

BACKGROUND OF THE INVENTION

1. Field of the Invention

The present invention relates to a carton applicable as a display package when assembled into a solid structure from a folded blank with a partition wall automatically erected thereinside thereby to vertically support a plurality of rather slender contents.

2. Description of the Prior Art

Conventional cartons are designed to display articles stored therein by removing a front upper part of each carton along perforations. Some cartons are equipped with partition walls or inner framework. For instance, one disclosed in Japanese Examined Utility Model Publication No. 56-38992 (38992/1981) is a rectangular parallelepiped carton consisting of a front wall, a rear wall, right and left side walls, a bottom wall and a top wall. This carton is such that an upper part of the front wall is detachable at a strip means or tear line formed in the front wall and right and left side walls, and moreover, a step portion, i.e., an inner frame is secured when a flap connected to an upper end of the rear wall is folded inward. In another prior art, a separate body of a partition wall is fitted inside the carton after the upper portion of the front wall is removed along a perforated line.

While merchandise goods when completely filling the carton of the above-described first example are best shown effectively on the step portion, if the goods are rather slender and easy to lie, the display effect is worsened as the remaining number of goods decreases. In addition, the blank needs an area for the flap at the upper edge of the rear wall to obtain the step portion, which leads to an increasing inconvenience at the manufacturing time and much waste of paper, eventually, raising costs.

In the latter example, on the other hand, to assemble the carton takes labor because of the necessity of fitting the separate partition wall from outside, that is, packaging efficiency is low. Since carton main bodies and partition walls should be paired at all times at the assembly line, the transfer and storage of these parts require complicated management heretofore.

SUMMARY OF THE INVENTION

The object of the present invention is therefore to provide a carton applicable as a display package, which is simple to assemble and superior in packaging efficiency, with an excellent display effect to hold even a small number of goods stored therein not to lie while a front upper part is cut off.

In order to accomplish the aforementioned object, a carton according to the present invention is made up of a blank including a front wall, a rear wall, a right and a left side walls, flaps constituting a top wall and flaps constituting a bottom wall. The blank constituting the carton further includes a partition wall means of a cross in a plan view connected to any of the walls. The partition wall means has a lateral partition wall to traverse the carton in a right-and-left direction along approximately the center of the carton thereby dividing the interior of the carton into front and rear sections, and a longitudinal partition wall to cross the carton in a back-and-forth direction thereby dividing the interior of the carton to right and left sections. The front wall is provided with perforated tear means traversing approximately the center thereof in the right-and-left direction, while the right and left side walls or/and the rear wall have a tear part connected to outer ends of the right-and-left perforated tear means which is to be cut out to separate an upper part of the carton from a lower part of the carton.

In the above-described constitution, since the partition wall means is integral with the carton, a cross-shaped partition is obtained inside the carton simultaneously when the carton is assembled and erected, allowing goods to be stored and packed directly in the carton, thus facilitating efficient packaging of goods. Moreover, goods on display in the carton are supported by the partition and therefore prevented from lying even when the number of goods is small. An excellent display effect is ensured.

The tear part in at least either one of the side walls may be a perforated cut line extending in a lateral direction. Contained articles are displayed well even when the carton is turned sideways, i.e., even when the side wall of the carton is faced front.

According to a preferred embodiment, the blank used to form the carton includes a partition wall connected to one wall located at either of the right and left ends thereof in a lateral direction, preferably, to an end of the rear wall of the blank. The partition wall comprises a lateral partition part which traverses a lower section of the carton right and left along approximately the center of the carton, with both ends thereof bonded to inner faces of the right and left side walls, thereby dividing the interior of the carton into front and rear sections, and a longitudinal partition part which is connected to an upper portion of the lateral partition element and bent rearward approximately perpendicularly, with an end thereof bonded to an inner face of the rear wall, thereby dividing the interior of a rear half of the carton to right and left sections. The front wall has a longitudinal partition flap formed by an U-shaped cutout which is at approximately central portion of the front wall, and perforated tear means extending from the U-shaped cutout to both right and left side ends of the front wall. The longitudinal partition flap is bent rearward to be bonded with the longitudinal partition element at its end thereby dividing the interior of a front half of the carton to right and left sections. The right and left side walls or/and the rear wall have a tear part connected to outer ends of the right-and-left perforated tear means which is to be cut out to separate an upper part of the carton from a lower part of the carton.

More preferably, the U-shaped cutout in the front wall is defined by a pair of slant tear lines extending from an upper and a lower ends of one longitudinal fold line and a longitudinal tear line connecting upper ends of the pair of slant cutout lines, whereby the longitudinal partition element is shaped to extend slantwise upwards, with right and left inner ends of the perforated tear means coinciding with the slant cutout lines.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
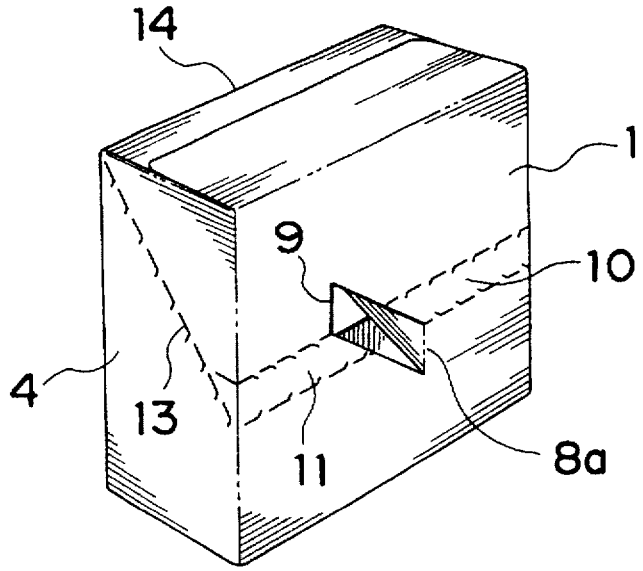
FIG. 1 is a perspective view of a carton according to a first embodiment of the present invention.
Figure 2:
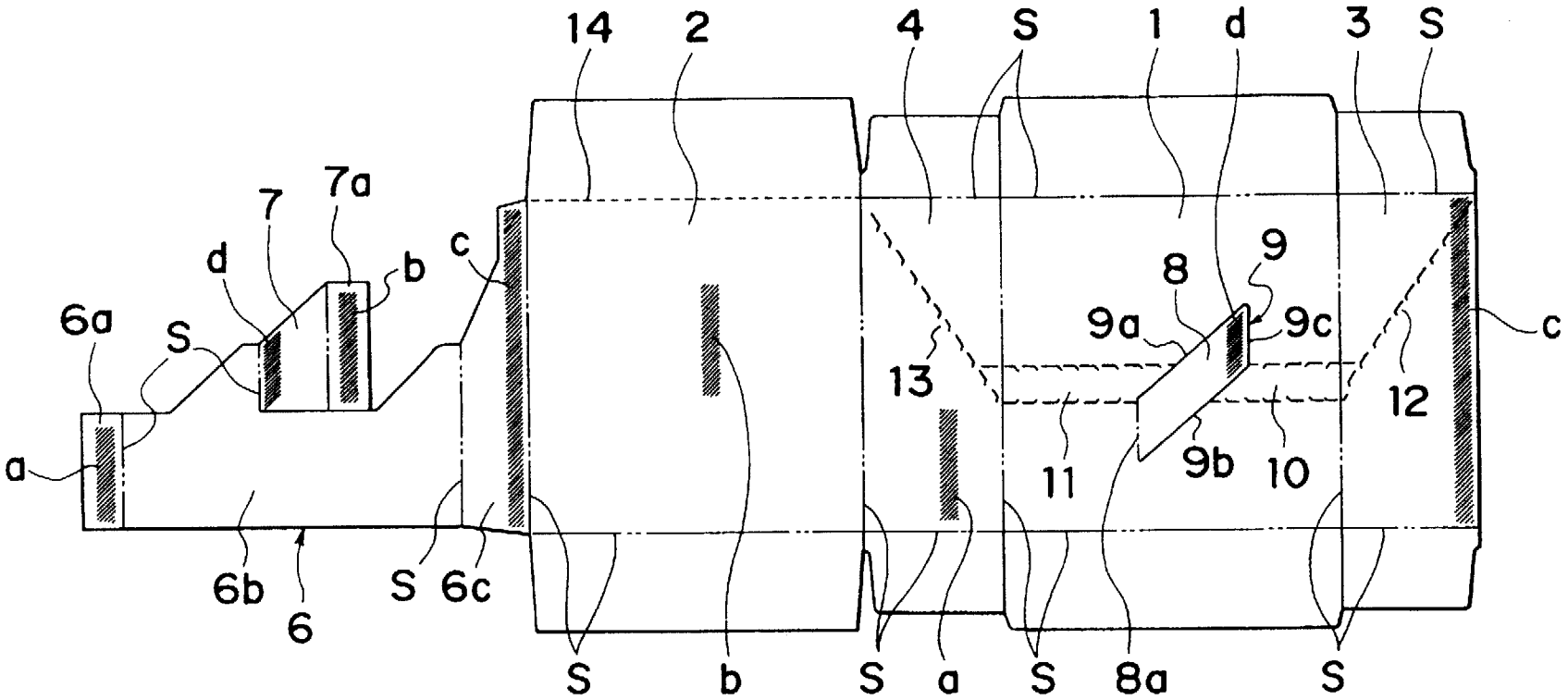
FIG. 2 is a plan development of a blank to form the carton of FIG. 1, seen from the interior side.

A first embodiment of the present invention will be described with reference to FIGS. 1–5. As shown in FIGS. 1 and 2, a carton according to a first embodiment of the present invention is a rectangular parallelepiped of a front wall 1, a rear wall 2, a right and a left side walls 3, 4, a top wall and a bottom wall. At a nearly central portion of the front wall 1 is formed a longitudinal cutout partition flap 8 which is defined by a U-shaped cutout 9 extending upper rightwards and an up-and-down fold line 8*a*. The U-shaped cutout 9 is defined by a pair of slant cutout lines 9*a*, 9*b* parallel to each other and a cutout line 9*c* parallel to the fold line 8*a*. A parallelogram opening is obtained when this partition flap 8 is folded inward of the carton. Horizontal perforated tear means 10, 11 extend from the opening, more specifically, from cutout lines 9*a*, 9*b* to right and left side ends of the front wall 1. In other words, inner ends of the perforated tear means 10, 11 coincide with the inclined cutout lines 9*b*, 9*a*, respectively. Right and left side walls 3, 4 have perforated cut lines 12, 13 running slantwise from outer ends of the corresponding perforated tear means 10, 11 to respective upper rear corners. Moreover, perforations 14 connecting upper ends of the perforated cut lines 12 and 13 are formed between the rear wall 2 and a flap of the top wall. The perforated tear means and cut lines 10, 11, 12, 13 and perforations 14 constitute a sequence of cutout means, so that a front upper part of the carton can be removed slantwise as is clearly shown in FIGS. 4 and 5. A partition wall means of a cross in a plan view which is composed of a lateral partition wall 6, a longitudinal partition wall 7 and the longitudinal cutout partition flap 8 is integrally constructed with the carton main body at a lower section inside the carton.

The whole of a blank to form the carton of the first embodiment is indicated in FIG. 2. As shown in FIG. 2, the side wall 3, front wall 1, side wall 4, rear wall 2, lateral partition wall 6 and a lateral partition wall attachment margin 6*a* are connected via fold lines S. At the same time, flaps formed at upper and lower ends of the side wall 3, front wall 1, side wall 4 and rear wall 2 to form the top and bottom walls are connected via fold lines S. The lateral partition wall 6 is constituted of an inner wall 6*c* connected to a side edge of the rear wall 2, a wall main body 6*b* connected to the inner wall 6*c* and the attachment margin 6*a* connected to the main body 6*b*. The longitudinal partition wall 7 projects upward at a central upper portion of the main body 6*b* via a fold line S. The longitudinal partition wall 7 has an attachment margin 7*a*.

In the above constitution of the blank, the blank is ready to fold and attach at fold lines S, thus simplifying an attachment/application process. High-speed attachment is enabled. When many blanks are printed and punched in a single sheet of paper, the paper is wasted little, so that the carton is manufactured at low cost. Oblique line areas in FIG. 2 show attachment positions of flaps.

Figure 3A:
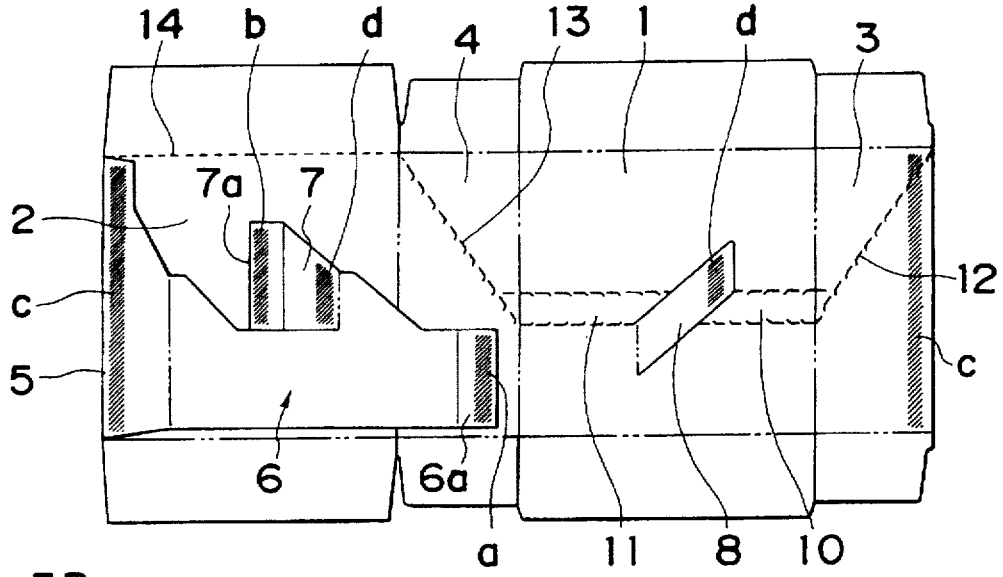
FIG. 3 explains an attachment process for the blank, FIG. 3(A) being a plan view in the middle of the process and FIG. 3(B) being a plan view in the completed state.
Figure 3B:
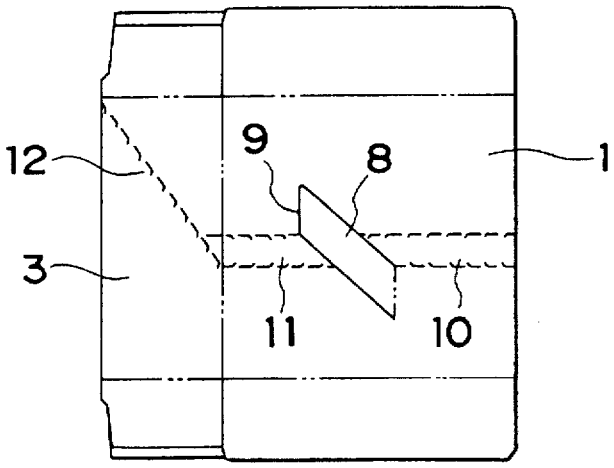
Figure 4A:
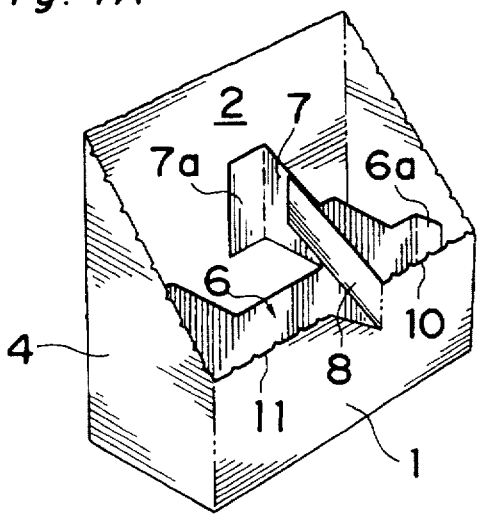
FIG. 4 shows an inner partition wall obtained by cutting off an upper part of the carton, FIG. 4(A) being a perspective view without goods stored in the carton and FIG. 4(B) being a plan view with goods stored.
Figure 4B:
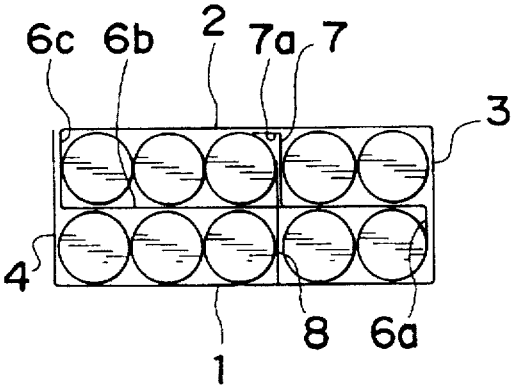

FIG. 3 shows the attachment process. First, the blank is folded at the fold line S between the rear wall 2 and the inner wall 6*c*. The partition wall means is in turn attached to the confronting side wall 4 and rear wall 2 via the attachment margins 6*a*, 7*a* at the attachment positions a, b indicated by oblique line areas, into a state represented in FIG. 3(A). The blank is further folded at the fold line S between the front wall 1 and the side wall 4, and an outer edge of the side wall 3 and an end of the cutout partition flap 8 are attached respectively to the confronting inner wall 6*c* and longitudinal partition wall 7 at the designated attachment positions c, d. The attachment process is hence completed, which is shown in FIG. 3(B). The carton is finished in a folded state. The partition wall means consisting of the lateral partition wall 6, longitudinal partition wall 7 and longitudinal cutout partition flap 8 is formed in one body with the carton main body at the lower section inside the carton in the folded state. Therefore, when the carton is assembled, the cross-shaped partition wall is erected as shown in FIGS. 4(A) and 4(B).

According to the first embodiment of the carton, the wall main body 6*b* is attached via the attachment margin 6*a* to the confronting side wall 3, whereby a partition wall traversing approximately the center inside the carton is formed in parallel to the front wall 1. At the same time, the longitudinal partition wall 7 projecting at the central upper portion of the main body 6*b* is folded at the fold line S and attached via the attachment margin 7*a* to the confronting rear wall 2, and further the longitudinal cutout partition flap 8 formed of the U-shaped inclined cutout 9 at the central portion of the front wall 1 is folded to extend slantwise upward at the fold line S and the end of the partition flap 8 is attached to the longitudinal partition wall 7, thereby to form a partition wall dividing the interior of the carton longitudinally. A central portion of the laterally traversing partition wall projects upward, while the longitudinal partition wall 7 extends from a central lower portion of the front wall 1 slantwise upward to the rear wall 2. The partition wall means in its entirety is accordingly crossed in a plan view as in FIG. 4(B).

In order to package goods in the carton of the first embodiment, the carton is erected thereby to form the cross-shaped partition wall and then, flaps of the bottom wall connected to lower edges of the front wall 1, rear wall 2 and right and left side walls 3, 4 are folded and attached thereby to obtain the bottom wall. A plurality of articles or goods, e.g., 10 goods in the illustrated example are stored along the cross-shaped partition wall. Thereafter, flaps of the top wall connected to upper edges of the front wall 1, rear wall 2 and side walls 3, 4 are folded and attached each other, which constructs the top wall. The goods are completely packaged in this manner.

Figure 5:
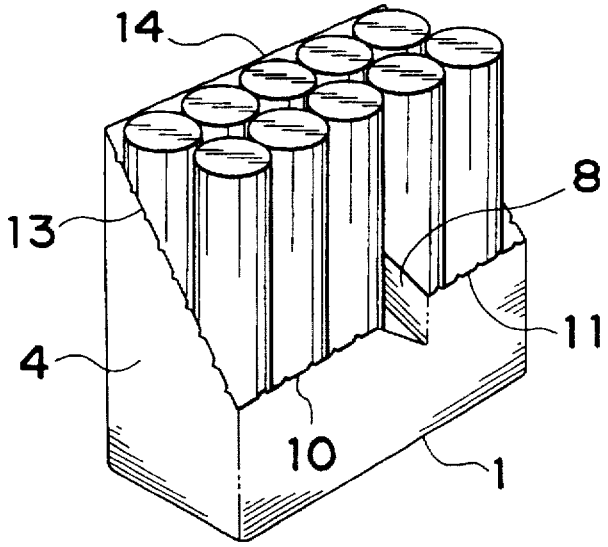
FIG. 5 is a perspective view of the carton with the upper part cut off to display goods.

When the carton holding the goods packaged as above is to be displayed at a store, inner ends of the perforated tear means 10, 11 are pulled apart to cut out the carton from the opening which is formed by pressing of the U-shaped flap 8 of the front wall 1 inward. An upper part of the front wall 1 opened by the above cutting-out is pulled up, consequently letting upper parts of the side walls 3, 4 torn slantwise rearward along the perforated cut lines 12, 13, then the rear wall flap is separated along the perforations 14 from the rear wall 2. As a result of this, a front upper part of the carton is removed. The carton is turned into a display state as shown in FIG. 5. Even when the number of goods stored in the carton is reduced during the sale and even if the goods are slim, owing to the partition wall means supporting the goods, the contents are kept standing, in other words, displayed efficiently.

Figure 6:
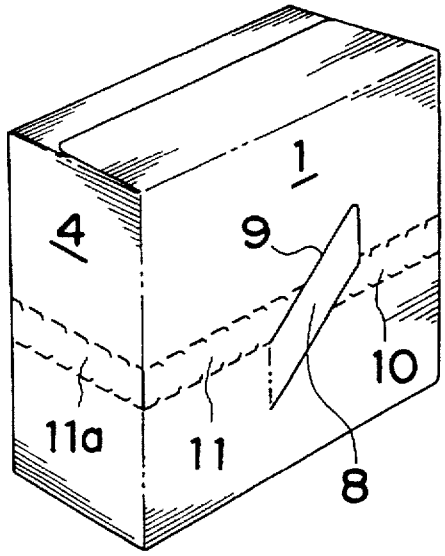
FIG. 6 is a perspective view of a carton according to a second embodiment of the present invention.
Figure 7:
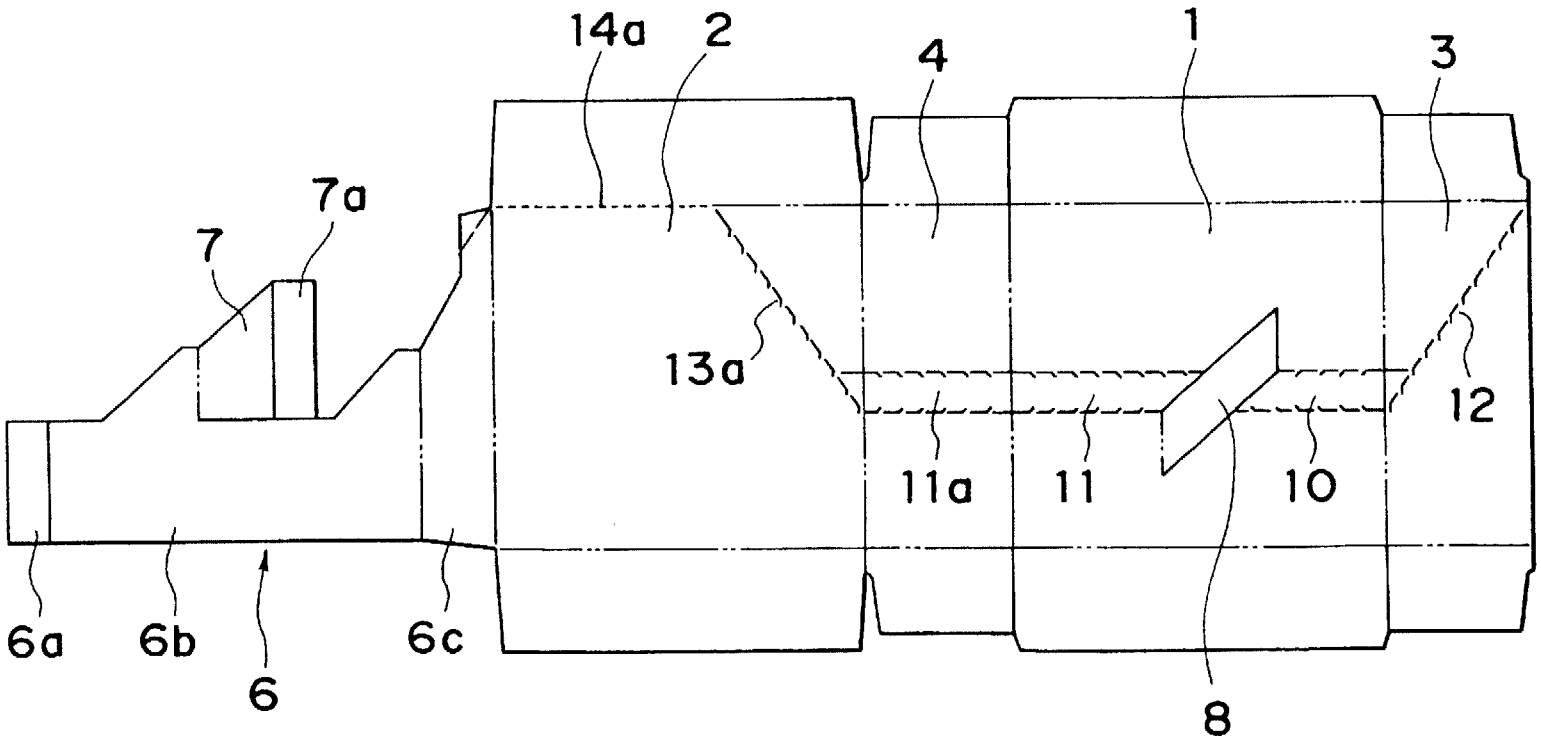
FIG. 7 is a plan view of a blank to form the carton of FIG. 6.

A second embodiment of the present invention will be discussed with reference to FIGS. 6 and 7. A carton according to the second embodiment is substantially the same as the first embodiment except the following points to be depicted below. The U-shaped cutout 9 is formed right upward at the central portion of the front wall 1, and the perforated tear means 11 is extended to cover the full width in a horizontal direction of the side wall 4. That is, the cutout means is constituted of the perforated cut line 12 running from an outer end of the perforated tear means 10 to reach the upper rear corner of the side wall 3, the above perforated tear means 11*a* continuous with an outer end of the perforated tear means 11 all over the width of the other side wall 4, and a perforated cut line 13*a* formed in the rear wall 2 slantwise upward from an outer end of the perforated tear means 11*a*. Accordingly, the upper part of the front wall as well as the upper part of one side wall and the top wall can be cut off in the constitution of the second embodiment.

The partition wall in the attachment process and in the assembled state of the carton of the second embodiment is essentially the same and also goods are packaged in the carton in the same manner as in the first embodiment.

Figure 8:
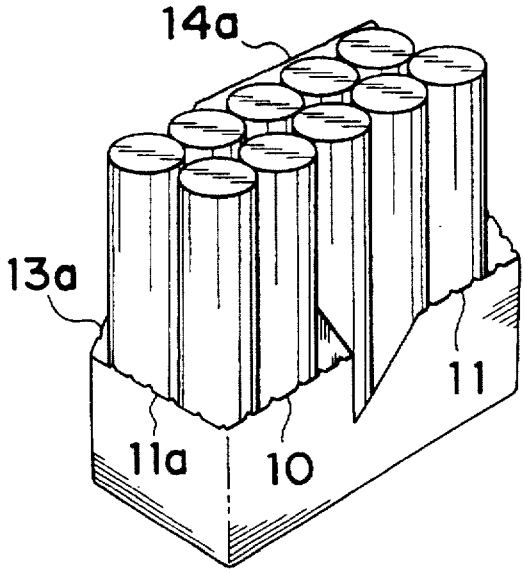
FIG. 8 is a perspective view of the carton of FIG. 6 with upper portions of a front wall and side walls cut off to display goods.

When the carton of the second embodiment containing articles is to be put on display, similar to the first embodiment, the perforated tear means 10, 11 and 11*a* are pulled apart starting from the opening of the U-shaped cutout 9, thereby separating the front wall 1 and side wall 4, then the separated upper parts of the front wall 1 and side wall 4 are pulled up to tear the side wall 3 off slantwise along the perforated cut line 12. Subsequently, the rear wall 2 is partially torn slantwise along the perforated cut line 13*a* and finally cut off at the perforations 14*a*. In consequence, upper parts of the front wall 1 and side wall 4, and the top wall of the carton are removed, as illustrated in FIG. 8. The first embodiment is fit to show the contents with the front wall 1 set front, while the second embodiment is utilizable also when the side wall 4 is directed front.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A carton applicable as a display package which is made up of a blank including a front wall, a rear wall, a right and a left side walls, flaps constituting a top wall and flaps constituting a bottom wall, said carton further comprising a partition wall means which is connected to any portion of the blank and has a lateral partition wall to traverse the carton in a right-and-left direction along approximately the center of the carton thereby dividing the interior of the carton to front and rear sections, and a longitudinal partition wall to cross the carton in a back-and-front direction thereby dividing the interior of the carton to right and left sections, the front wall being provided with perforated tear means traversing approximately the center thereof in the right-and-left direction, while the right and left side walls or/and the rear wall include a tear part connected to outer ends of the right-and-left perforated tear means which is to be cut out to separate an upper part of the carton from a lower part of the carton.

2. A carton as set forth in claim 1, wherein said tear part in at least either one of the side walls is constituted to be a perforated cut line extending in a lateral direction.

3. A carton applicable as a display package which is made up of a blank including a front wall, a rear wall, a right and a left side walls, flaps constituting a top wall and flaps constituting a bottom wall, further comprising a partition wall connected in a lateral direction to an end of one wall located at either of right and left ends of the blank, said partition wall including a lateral partition part which traverses a lower section of the carton right and left along approximately the center of the carton, with both ends thereof bonded to inner faces of the right and left side walls, thereby dividing the interior of the carton to front and rear sections, and a longitudinal partition part which is connected to an upper portion of the lateral partition part and bent rearward approximately perpendicularly, with an end thereof bonded to an inner face of the rear wall, thereby dividing the interior of a rear half of the carton to right and left sections, the front wall having a longitudinal partition flap formed by a U-shaped cutout which is at an approximately central portion of the front wall, and perforated tear means extending from the U-shaped cutout to both right and left side ends of the front wall, said longitudinal partition flap being bent rearward to be bonded with the longitudinal partition part at its end thereby dividing the interior of a front half of the carton to right and left sections, the right and left side walls or/and the rear wall including a tear part connected to outer ends of the right-and-left perforated tear means which is to be cut out to separate an upper part of the carton from a lower part of the carton.

4. A carton as set forth in claim 3, wherein said U-shaped cutout in the front wall is defined by a pair of slant cutout lines extending from an upper and a lower ends of one longitudinal fold line and a longitudinal cutout line connecting upper ends of the pair of slant cutout lines, so that said longitudinal partition flap is shaped to extend slantwise upwards, with right and left inner ends of the perforated tear means coinciding with the slant cutout lines.

5. A carton as set forth in claim 3, wherein the wall connected to said partition wall is the rear wall.

* * * * *